US005816154A

United States Patent [19]

Stuart

[11] Patent Number: 5,816,154

[45] Date of Patent: Oct. 6, 1998

[54] PRINT CYLINDER SUPPORT FOR AXIAL REMOVAL OF A CYLINDRICAL SLEEVE

[75] Inventor: Warner Hugh Stuart, Thatcher, Id.

[73] Assignee: Bryce International, L.L.C., Memphis, Tenn.

[21] Appl. No.: 853,405

[22] Filed: May 9, 1997

[51] Int. Cl.[6] ..... B41F 27/00

[52] U.S. Cl. ..... 101/216; 101/375; 101/486

[58] Field of Search ..... 101/212, 216, 101/375, 376, 152, 153, 477, 218, 483, 486

[56] References Cited

U.S. PATENT DOCUMENTS

| | | | |
|---|---|---|---|
| 627,579 | 6/1899 | Frisbee . | |
| 637,580 | 11/1899 | Hett . | |
| 1,329,325 | 1/1920 | Mascord . | |
| 1,451,726 | 4/1923 | Zuckerman . | |
| 1,737,378 | 11/1929 | Littell . | |
| 2,460,504 | 2/1949 | Huebner | 101/1 |
| 3,164,083 | 1/1965 | Irvine, Jr. | 101/93 |
| 3,738,265 | 6/1973 | Saueressig | 101/152 |
| 3,789,757 | 2/1974 | Motter et al. | 101/153 |
| 4,119,032 | 10/1978 | Hollis | 101/216 |
| 4,386,566 | 6/1983 | Moss | 101/375 |
| 4,438,695 | 3/1984 | Maier et al. | 101/153 |
| 4,461,663 | 7/1984 | Tachibana et al. | 156/86 |
| 4,697,516 | 10/1987 | Rombout | 101/216 |
| 4,807,527 | 2/1989 | Knauer | 101/216 |
| 4,823,693 | 4/1989 | Köbler | 101/218 |
| 4,856,425 | 8/1989 | Kobler | 101/212 |
| 4,901,641 | 2/1990 | Steiner et al. | 101/152 |
| 4,913,048 | 4/1990 | Tittgemeyer | 101/141 |
| 4,991,503 | 2/1991 | Morner | 101/170 |
| 5,101,726 | 4/1992 | Lübke et al. | 101/216 |
| 5,161,464 | 11/1992 | Albrecht | 101/375 |
| 5,188,027 | 2/1993 | Fantoni | 101/216 |
| 5,237,920 | 8/1993 | Guaraldi | 101/216 |
| 5,241,905 | 9/1993 | Guaraldi et al. | 101/216 |
| 5,282,418 | 2/1994 | Uera | 101/216 |
| 5,289,769 | 3/1994 | Lewis | 101/218 |
| 5,309,832 | 5/1994 | Merkel et al. | 101/216 |
| 5,370,047 | 12/1994 | Compton | 101/216 |
| 5,398,604 | 3/1995 | Burke et al. | 101/216 |
| 5,638,754 | 6/1997 | Steinmeier et al. | 101/477 |

*Primary Examiner*—Christopher A. Bennett
*Attorney, Agent, or Firm*—Luedeka, Neely & Graham, P.C.

[57] ABSTRACT

Removable print roll sleeves are changed on a printing press without removal of a respective print roll from the press frame by securing the position of the print roll on the drive side axle bearing while the outboard axle bearing for the roll is removed. A bracket on a support tree has a motorized strut which bears upon an extension of the print roll axle shaft from the drive side axle bearing. This support tree may be rotated 90° about a vertical axis when not in use for minimum interruption and storage. On the outboard side of the print cylinder, the axle shaft bearing is mounted on a bearing carriage for disengagement from the axle shaft journal and withdrawn by a lead screw at a 45° angle along a slide plate.

39 Claims, 3 Drawing Sheets

PRINT CYLINDER SUPPORT FOR AXIAL REMOVAL OF A CYLINDRICAL SLEEVE

BACKGROUND OF THE INVENTION

The present invention relates to printing presses of the type in which one or more printing rolls are provided with a sleeve for transferring an image to the medium being printed, the printing sleeve being selectively removable from the roll body or carrier.

Printing sleeves are removable from respective rolls by various means developed by the prior art including pneumatic and mechanical devices for retaining and releasing a sleeve from the roll structure. Separation of the sleeve from the roll structure is by axial displacement, usually manually, over one end of the roll axle. In the past, sleeve replacement has generally required that the entire print roll be removed from the printing machine frame. Sleeve replacement by this method is labor intensive and time consuming.

Printing presses of late manufacture are provided with automated roll handling systems which reduce the labor and time involved in sleeve changes, but at great expense and use of valuable floor space in the proximity of the press.

It is therefore an object of the present invention to provide a printing press having print rolls with sleeves that may be replaced without removal of the rolls from the press.

Another object of the present invention is to provide a printing press designed to support the print roll in the press while enabling removal and replacement of the sleeve.

Still another object of the present invention is to provide a print roll having at least one removable bearing.

Yet another object of the present invention is to provide a removable sleeve print roll in which the sleeve will clear the bearing retainer and machine frame when the sleeve is withdrawn axially from the roll while the roll is supported on the opposite side of the press.

A further object of the invention is to provide a conveniently removable bearing retainer which is rigid and immoveable in the operating position.

A still further object of the invention is to provide a removable bearing retainer for a print roll which may be easily relocated to the exact position from which it was removed.

It is also an object of the invention to provide a support mechanism for print rolls within the press frame in combination with a bearing retainer retraction system which permits the installation and removal of printing sleeves without removing the print cylinder from the press.

Also considered an object of the present invention is a print roll support system which is easily retrofitted to existing presses.

SUMMARY OF THE INVENTION

These and other objects of the invention to become apparent from the following description are achieved by a printing machine having one or more printing rolls carrying removeable cylindrical sleeves for roll printing surfaces. These printing rolls have first and second shaft members that extend axially from opposite roll ends for rotational support in first and second bearings, respectively. The bearings are supported by the machine side frames. The second shaft member supported by the second bearing is axially extended past the second bearing. The cylindrical print sleeve is removed from the printing roll by axial displacement over the end of the first shaft member supported by the first bearing. Support of the first shaft member includes a housing that may be released from the first bearing and a retractor mechanism for retracting the housing radially from the roll axis sufficiently to remove the print sleeve axially through a cylindrical removal space. While the first bearing is retracted from the corresponding support shaft, the printing roll is supported by the shaft in the second bearing and counterpoise member. The counterpoise member includes an actuator to engage that portion of the second shaft member that extends past the second bearing to impose a countermoment on the shaft against rotation of the printing roll in a vertical plane about a horizontal axis through the second bearing.

The counterpoise member also includes a column positioned on the drive side of the machine for rotation about a vertical axis. The column placement is proximate to the print roll shaft extensions from the second or drive side bearings. Extending from this column is a fluid strut adapted to engage the drive side print roll second shaft extension. The strut engagement levers the print roll weight about a horizontal axis transverse to the roll axis at the drive side bearing. Consequently, a foot element of the strut bears against the print roll second shaft extension on the drive side of the machine to stabilize the position of the roll axis on the outboard side of the machine when the outboard support bearing is withdrawn.

The first bearing which supports the outboard side first axle shaft projection is mounted on a translation carriage. A carriage base is dovetailed to fit between and under a pair of reverse tapered guide rails secured to a base frame having a sliding support surface. A lead screw secured to the base frame for rotation about the screw axis engages an internal thread element of the carriage. The carriage base frame is mounted on the respective machine side frame to align the screw axis at an acute angle to the print roll axle shaft. Displacement of the carriage by rotation of the lead screw withdraws the first bearing from the journal support position of the outboard side axle shaft extension. Removal of the bearing clears the space required to axially draw the print sleeve over the end of the respective roll for a change of the sleeve without removing the print roll from between the machine side frames.

BRIEF DESCRIPTION OF THE DRAWING

A preferred embodiment of the invention is hereafter described in detail relative to the drawings wherein.

DESCRIPTION OF THE PRFERRED EMBODIMENTS

Figure 1:
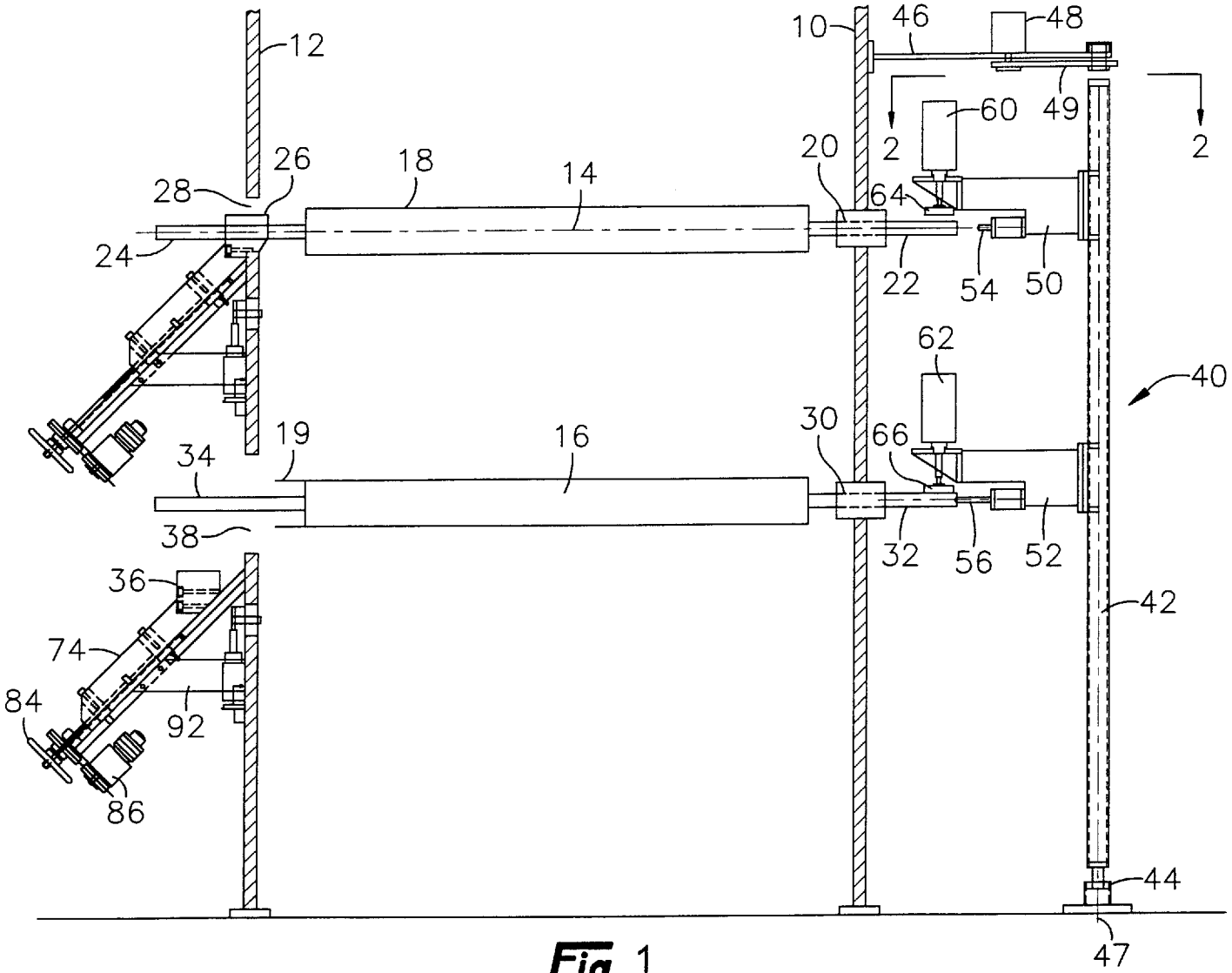
FIG. 1 is a partial end elevation of a printing machine combined with the present invention.

FIG. 1 schematically illustrates the end-view elevation of a printing press having a drive side frame line 10 and an outboard frame line 12. Between the frame lines 10 and 12 are suspended print rolls 14 and 16. A drive side frame bearing 20 supports the drive side axle shaft extension 22 from the upper print roll 14. The outboard side axle shaft extension 24 is supported by an outboard bearing 26.

With respect to the lower print roll 16, drive side frame bearing 30 supports the drive side axle shaft extension 32 from the lower roll 16. The outboard side axle shaft extension 34 is supported by an outboard bearing 36.

The outboard bearings 26 and 36 are retractable from their respectively normal operating positions 28 and 38 on the frame for clearance to remove the roll sleeves 18 and 19 axially over the respective outboard axle shafts 24 and 34. Further description of the mechanism for retracting the drive side bearings 26 and 36 will follow.

Alongside the print roll drive side is a support tree 40 comprising a structural column 42 supported at its bottom by a thrust bearing base 44 and at its top by a stabilizing bracket 46. Preferably, rotation of the column 42 about its vertical axis 47 is driven and controlled by a rotational drive motor 48 and transmission 49. In vertical and lateral alignment with each of the print roll axes are brackets 50 and 52.

The FIG. 1 arrangement of the support tree 40 and brackets 50 and 52 relative to the print rolls 14 and 16 is typical only for printing machines having vertically stacked rolls 14 and 16. Other machine roll configurations such as those represented by U.S. Pat. Nos. 5,370,047; 4,697,516 and 1,329,325 may require different drive side support tree arrangements wherein the base 44 and top stabilizing bracket 46 are laterally adjustable or selectively located to place the tree 40 axis in-plane with a respective print roll axis. In like manner, the location of the brackets 50 and 52 along the length of the tree 40 may be adjustable.

Secured to each of the brackets 50 and 52 in projected coaxial alignment with each of the axles 22 and 32 are extensible air supply nozzles 54 and 56. When actuated by air pressure, these nozzles coaxially extend themselves into a pressure tight fluid contact with an air conduit opening in the end of a roll axle 22 or 32. Air pressure delivery into the air conduit actuates a cylinder sleeve release mechanism within the respective print roll to release the cylinder sleeve 18 or 19. When released, the sleeve 18 or 19 may be removed from the respective roll by axial extraction over the axle shaft extension.

Also secured to each of the cantilevered brackets 50 and 52 are respective fluid extension struts 60 and 62. Each fluid strut has a shoe 64 and 66 at the end of a fluid extensible rod for engaging a respective axle shaft extension. The structural strength of the support tree assembly 40 must accommodate the load moment imposed by a print roll weight levered about a horizontal axis through the drive side bearings 20 and 30, such horizontal axis being orthogonal to the respective print roll axes. When a fluid strut shoe is engaged with an axle shaft extension, the outboard bearing for the same print roll may be withdrawn from the respective outside axle shaft extension without structural interference between the frame and the print sleeve removal path.

Figure 2:
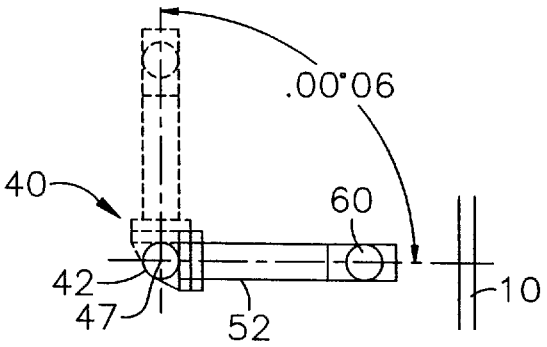
FIG. 2 is a plan view of the present invention counterpoise assembly as viewed along cutting plane 2—2 of FIG. 1.

It will be noted from FIG. 2 that the cantilevered bracket structure attached to the support tree 40 is normally aligned with an inoperative park position by rotation of the tree 40 about its axis 47. Such rotation of the tree 40 to and from operational alignment with the axle shaft extensions is driven by the motor 48 and transmission 49 unit.

Figure 4:
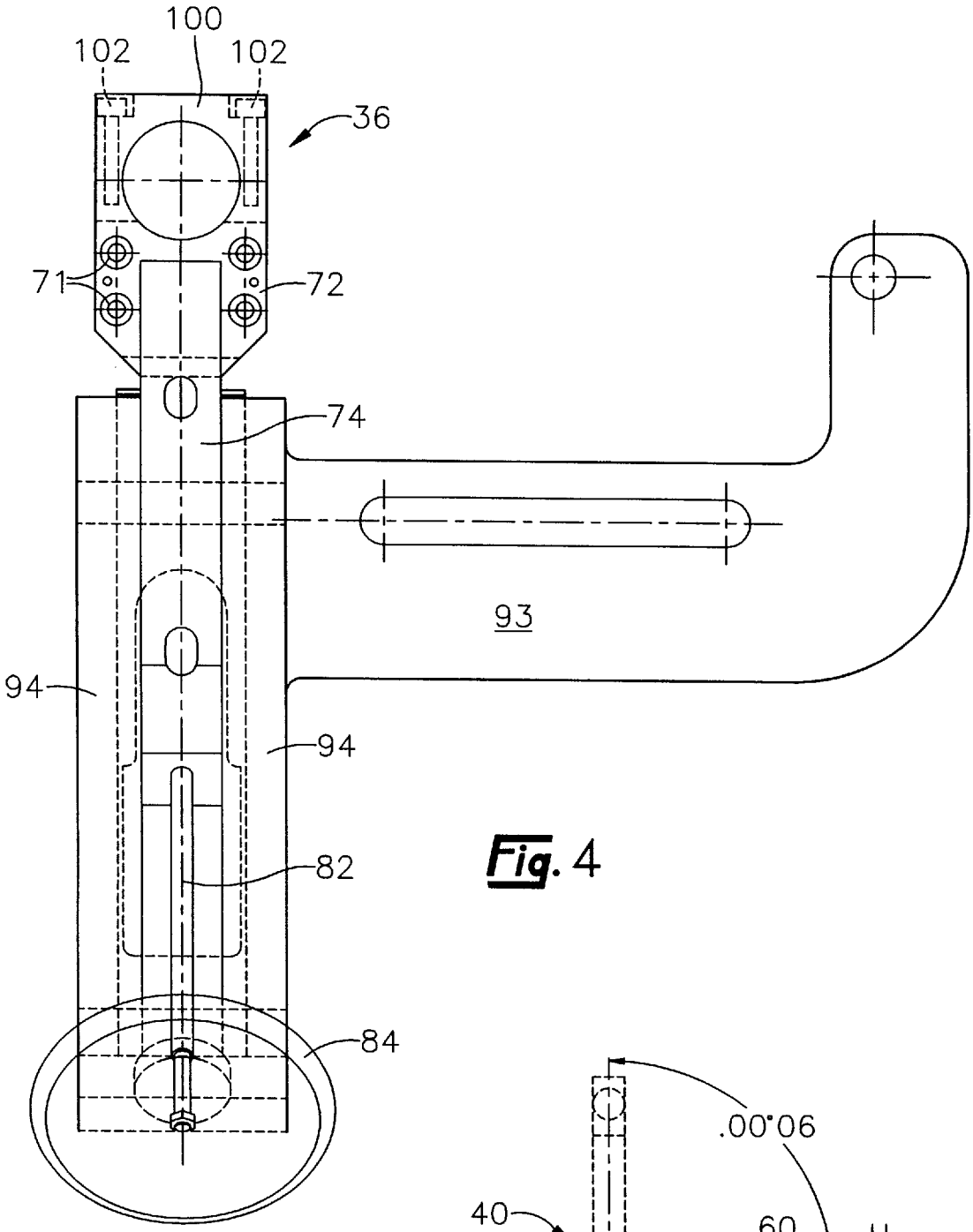
FIG. 4 is a front elevation of the bearing mount displacement mechanism of the present invention.
Figure 3:
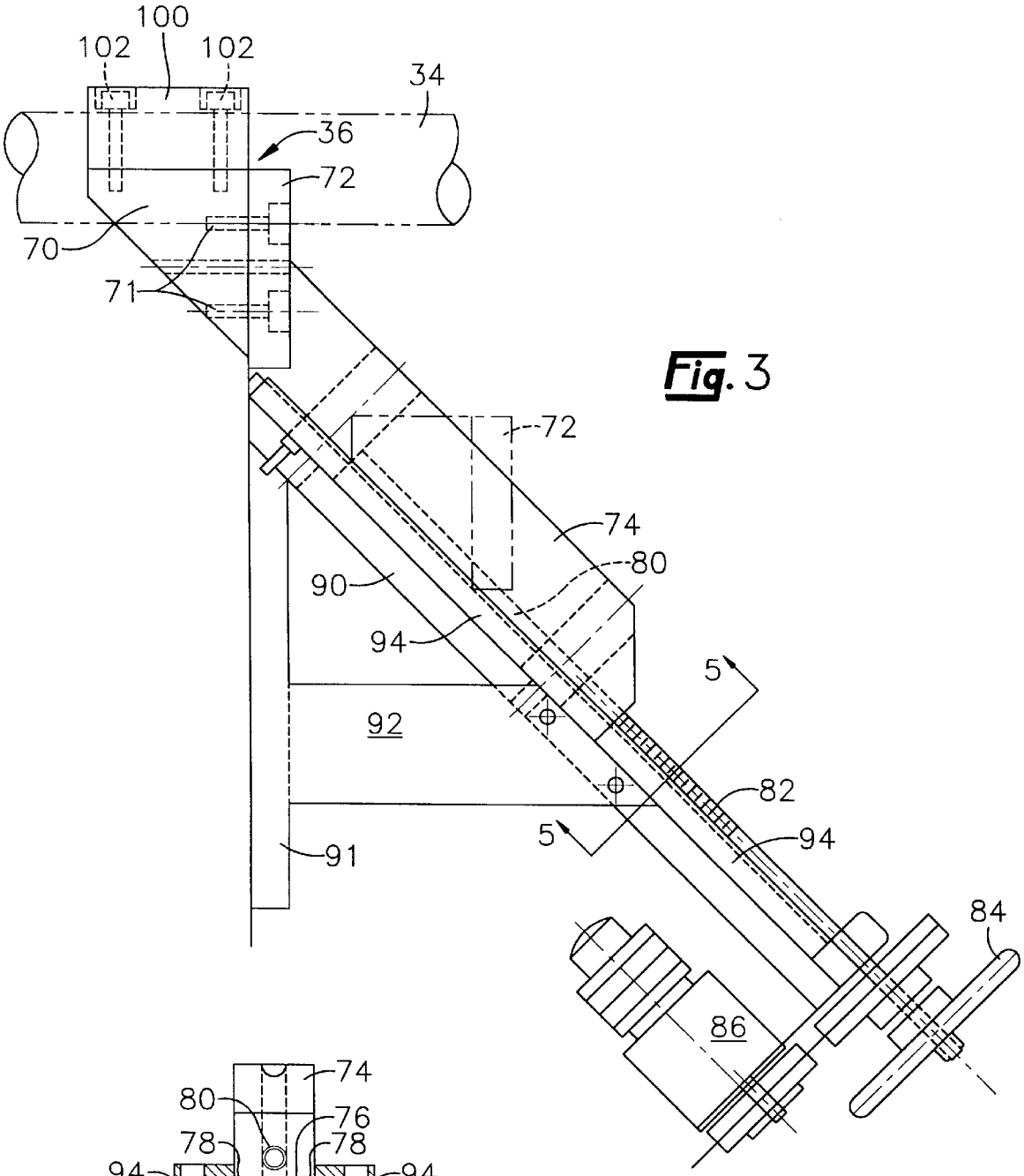
FIG. 3 is a side elevation of the bearing mount displacement mechanism of the present invention.
Figure 5:
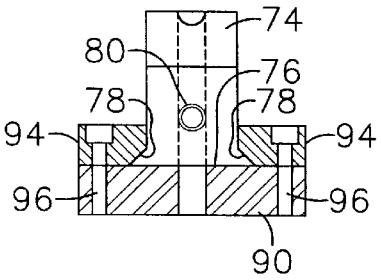
FIG. 5 is a cross sectional view of the invention carriage and slide plate.

With reference to FIGS. 3–5, the outboard bearing 36 comprises a bearing saddle 70 that cradles no more than about half of the axle shaft 34 circumference. This bearing saddle 70 is face mounted by threaded fasteners 71 to a carriage flange 72. The carriage flange 72 is a rigidly integral element of the carriage body 74. The carriage body 74 is preferably a solid steel block having a flat-milled bottom surface 76 flanked by dovetail flares 78. An internally threaded bore hole 80 having a bore axis parallel with the carriage bottom surface receives a positioning control lead screw 82. Rotation of the lead screw 82 is effected by either a handwheel 84 or by an operatively connected air motor drive 86.

Supporting the carriage body 74 is a base plate 90 that is secured to the press outboard frame 12 at an approximately 45° angle to the vertical plane by a triangular bracket comprising a faceplate 91 and a pair of flanking truss plates 92. For greater stability and positional security, the faceplate 91 may also include an outrigger plate 93 as illustrated by FIG. 4 for greater torque and moment force. Dovetail clamp bars 94 flank the carriage body 74 and overlay the flares 78. Machine screws 96 secure the assembly with manufacturing tolerances that clamp the carriage 74 immovably against the base plate 90 when required.

When the outboard bearing 36 is in operative support of the axle shaft extension 34, a journal cap 100 spans the top half of the axle shaft journal section and anchors the axle shaft to the bearing saddle 70 by cap screws 102. This journal cap 100 is removed to facilitate retraction of the saddle 70 when a change of the roll sleeve 19 is desired.

Proceeding next with a description of the invention utility and deployment, a roll sleeve 19 is identified for replacement and the journal cap 100 is disengaged from its respective saddle 70. The support tree 40 is then rotated about the column axis 47 by motor 48 and transmission 49. Such rotation vertically aligns the centerplane of bracket 52 with the axis of print roll 16. In such alignment, the air nozzle 56 is extended into the pressure socket of axle shaft 32 to release the sleeve 19 locking mechanism not shown. The loading strut 62 extends its shoe 66 into engagement with the axle shaft 32 to oppose counterclockwise torque about the drive side bearing 30.

With the weight of roll 16 now in cantilevered support, the dovetail clamping machine screws 96 are loosed to release the bearing pressure of the dovetail clamp bars 94 against the dovetail flares 78 of carriage 74. Rotation of the handwheel 84 or air motor 86 displaces the carriage 74 by rotation of lead screw 82 thereby withdrawing the outboard bearing 36 from the frame aperture 38. The sleeve 19 may now be drawn axially over the outboard axle shaft extension through the frame aperture 38 and a replacement returned via the reversed procedure.

A position adjustable abutment element, not shown, that may be secured either to the frame 12 structure or to the face plate 91 is used to precisely limit the return position of the carriage body 94 and, hence, the repositionment of the bearing 36.

Having now fully described the preferred embodiments of my invention:

I claim:

1. In a printing machine having first and second side frames. first and second bearing supports on said respective side frames. bearings secured to said respective bearing supports and having at least one elongate printing roll carrying a removable cylindrical sleeve providing a cylindrical printing surface on the roll, said roll having first and second shaft members extending axially from opposite roll ends, said shaft members being rotatively supported by said machine side frames in said first and second bearings, respectively, for rotation about a roll axis, the second shaft member supported by said second bearing support extending axially beyond said second bearing support, said cylindrical sleeve being removable by axial displacement thereof over a first axial end of said roll and said first shaft member, the improvement comprising:

said first bearing support including a releasable housing for releasing the support from said first shaft member and a retractor mechanism for retracting the housing radially of the roll axis upon release of the same from the shaft member by an amount sufficient to enable removal of said sleeve from said roll while the printing roll remains supported by the second shaft member in said second bearing support on the second side frame; and a counterpoise member attached to a counterpoise column adjacent said second side frame and an actuator for actuating the counterpoise member to cause the member to selectively engage and disengage that portion of the second shaft member extending beyond said second bearing to support the roll with the portion of the shaft member extending beyond the second bearing against vertical rotation about a horizontal axis extending through said second bearing orthogonal to the roll axis.

2. The improvement of claim 1 wherein said actuator comprises a fluid motor secured to said counterpoise column and said counterpoise member includes a pressure foot for engaging the extension of said respective shaft member.

3. The improvement of claim 2 further comprising counterpoise column rotational means for rotating said column about said vertical axis to align said actuator with the shaft member.

4. The improvement of claim 1 wherein said first bearing support comprises a track having a predetermined radial displacement path and a bearing carriage moveably supported on said track for guiding movement of the bearing carriage along said radial displacement path.

5. The improvement of claim 4 wherein said displacement path is along a line substantially intersecting said roll axis at an acute angle.

6. The improvement of claim 5 wherein said bearing carriage comprises a lead screw and a manual or power-operated crank mechanism operatively connected between said carriage and said screw for displacing said bearing carriage along said track by rotation of said lead screw.

7. The improvement of claim 5 wherein said acute angle is about 45°.

8. The improvement of claim 5 wherein said displacement path and said roll axis are substantially in the same vertical plane.

9. In a printing machine having at least one printing roll, said printing roll having an axle having first and second rotational bearing surfaces thereon, an axis of rotation, and a substantially cylindrical print sleeve secured to said printing roll between said first and second rotational bearing surfaces on said axle said bearing surfaces having journal portions, said printing machine also having first and second rotational bearings confining said roll axle bearing surfaces, said sleeve being removable from said printing roll by axial displacement along said axle past said first rotational bearing surface, said axle having an axial extension past said second rotational bearing surface, said printing machine further having frame means for supporting said first and second rotational bearings, the improvement comprising:

abutment means for selective engagement with said axle extension to load said axle extension about an axis traverse to said axis of rotation proximate of said second rotational bearing; and, first bearing carriage means having a displacement path, said carriage means being secured to said frame means for disengaging and withdrawing said first bearing from said first rotational bearing surface along said displacement path at an acute angle to said roll axis of rotation.

10. A printing machine as described by claim 9 wherein said displacement path is set at about 45° to said roll axis of rotation.

11. A printing machine as described by claim 9 wherein said first bearing carriage means comprises a carriage element, a frame plate and a lead screw having an axis. said carriage element being supported by said frame plate.

12. A printing machine as described by claim 11 wherein said carriage element further comprises a cylindrical bearing saddle for engaging support of aid journal portion of said first rotational bearing surface.

13. A printing machine as described by claim 12 wherein said carriage element further comprises an internal follower thread for engaging said lead screw.

14. A printing machine as described by claim 13 wherein said carriage element further comprises a guide base for confining movement of said carriage to a predetermined direction along said displacement.

15. A printing machine as described by claim 14 wherein said guide base comprises a dovetail cross-section.

16. A printing machine as described by claim 11 wherein said frame plate comprises a planar slide surface for supporting said carriage element along said displacement path.

17. A printing machine as described by claim 16 wherein said plane slide surface further comprises a pair of guide ways secured to said slide surface for confining displacement of said carriage element along a displacement line substantially parallel with said displacement path.

18. A printing machine as described by claim 17 wherein said lead screw is secured to said frame plane for rotation about said lead screw axis coincident with said displacement line.

19. A printing machine as described by claim 18 wherein said carriage element further comprises a follower thread portion and said lead screw engages said follower thread portion of said carriage element.

20. A printing machine having first and second side frames, which comprises at least one printing roll having a axis, first and second roll ends and an axially removable sleeve for providing a cylindrical printing surface on the roll, said roll having a first shaft member extending coaxially with the axis of the roll from said first roll end and a second shaft member extending coaxially with said roll axis from said second roll end, said shaft members being rotatively supported by respective first and second bearings secured to respective side frames of the machine, bearing carriage means having a first of said bearings secured thereto for reciprocable displacement along a directional axis having an acute angle with said roll axis, said first bearing having first shaft member release means for permitting said first bearing to be selectively disengaged and displaced from said first shaft member sufficient to enable said sleeve to be axially removed therefrom, said second shaft member having an extension length past said second bearing, and abutment means for selective engagement with said extension length to positionally stabilize said roll axis when said first bearing is disengaged and displaced from said first shaft.

21. A printing machine as described by claim 20 wherein said acute angle of said carriage means displacement directional axis is approximately 45°.

22. A printing machine as described by claim 21 wherein said roll axis and said displacement directional axis are substantially aligned in a common plane.

23. A printing machine as described by claim 20 wherein said carriage means comprises a carriage element, a frame plate and a lead screw having an axis, said carriage element being supported by said frame plate.

24. A printing machine as described by claim 23 wherein said first shaft member contains a journal portion and said first bearing further comprises a cylindrical bearing saddle for engaging support of said journal portion of said first shaft member.

25. A printing machine as described by claim 24 wherein said carriage element further comprises an internal follower thread portion for engaging said lead screw.

26. A printing machine as described by claim 25 wherein said carriage element further comprises a guide base for confining displacement of said carriage element along said displacement directional axis.

27. A printing machine as described by claim 26 wherein said guide base comprises a dovetail cross section.

28. A printing machine as described by claim 23 wherein said frame plate comprises a planar slide surface for supporting said carriage element displacement along said displacement directional axis.

29. A printing machine as described by claim 28 wherein said planar slide surface further comprises a pair of guide ways secured to said slide surface for confining displacement of said carriage element along a displacement line substantially parallel with said displacement directional axis.

30. A printing machine as described by claim 29 wherein said lead screw is secured to said frame plate for rotation about a lead screw axis coincident with said displacement directional axis.

31. A printing machine as described by claim 30 wherein said lead screw engages said follower thread portion of said carriage element.

32. A bearing displacement apparatus for a machine having first and second machine frame members supporting an axially rotatable shaft, the shaft having an axis and first and second shaft bearings supported by said respective machine frame members, said apparatus comprising:

a carriage member having a guide base, a cylindrical bearing saddle having a saddle axis and an internal follower thread;

a frame plate having a planar slide surface, a translational movement plane and guide ways for supporting and confining said carriage member guide base a movement of said carriage member along said translational movement plane, said frame plate including frame brackets to secure said slide surface to the first machine frame member at an acute angle to the axis of the axially rotatable shaft; and, a lead screw having a screw axis secured to said frame plate for rotation about said screw axis, said lead screw being engaged with said internal follower thread to displace said carriage member along said frame plate by rotation of said lead screw about said screw axis.

33. A bearing displacement apparatus as described by claim 32 wherein said guide base is configured to a dovetail cross-section with said guide ways overlying dovetail flares.

34. A bearing displacement apparatus as described by claim 32 wherein said lead screw axis and said saddle axis are substantially aligned in a common plane.

35. A bearing displacement apparatus as described by claim 34 wherein said acute angle between said first frame member and shaft axis is about 45°.

36. A method of changing an axially removable roll sleeve on an axially elongated printing roll of a printing machine having first and second frame members, the printing roll having first and second shaft members and first and second bearings rotatively supporting said shaft members secured to respective first and second frame members, the shaft members longitudinally extending substantially coaxially from opposite roll ends, said first shaft member including a longitudinal extension past said first bearing, said sleeve being removed by axial displacement over said second shaft member and said second bearing having a selectively positioned saddle base to cradle said second shaft about no more than about half of the circumference of said second shaft member, said method comprising the steps of:

applying a moment force against said first shaft member extension to counter gravitational force on said printing roll;

controllably displacing said saddle base from a printing roll operating position along an angular direction that is acute to the axis of said shaft members and substantially coplanar therewith;

axially displacing and replacing a roll sleeve over said second shaft member; and, controllably returning said saddle base to said roll operating position.

37. A method as described by claim 36 wherein said saddle base is secured to a lead screw and positionally confined along a guideway whereby said saddle base is controllably displaced along said guideway by rotation of said lead screw.

38. A method as described by claim 36 wherein said second shaft member is selectively confined within said saddle base by a selectively removable bearing cap.

39. A method as described by claim 36 wherein said moment force is imposed upon said first shaft member by a selectively positioned fluid strut directed into engagement with said first shaft member extension to maintain said second shaft member at said roll operating position after said saddle base is displaced from support thereof.

* * * * *

UNITED STATES PATENT AND TRADEMARK OFFICE

CERTIFICATE OF CORRECTION

PATENT NO. : 5,816,154
DATED : October 6, 1998
INVENTOR(S) : Warner Hugh Stuart

It is certified that error appears in the above-identified patent and that said Letters Patent is hereby corrected as shown below:

Column 3, line 7, after "frame" insert -- line 12 --

Column 4, line 14, after "carriage" insert -- body --.

Column 4, line 38 , after "carriage" insert -- body --.

Column 4, line 39, after "carriage" insert -- body --.

Column 4, line 42, after "extension" insert -- 34 --.

Column 4, line 48, change "94" to -- 74 --.

Column 5, Claim 9, line 50, after "axle" insert -- , --.

UNITED STATES PATENT AND TRADEMARK OFFICE

CERTIFICATE OF CORRECTION

PATENT NO. : 5,816,154

DATED : October 6, 1998

INVENTOR(S) : Warner Hugh Stuart

It is certified that error appears in the above-identified patent and that said Letters Patent is hereby corrected as shown below:

Column 6, Claim 12, line 10, change "aid" to -- said --.

Column 6, line 18, after "displacement" insert -- path --.

Column 7, Claim 32, line 42, change "a" to --for --.

Signed and Sealed this

Twenty-seventh Day of April, 1999

*Attest:*

Q. TODD DICKINSON

*Attesting Officer*

*Acting Commissioner of Patents and Trademarks*